United States Patent [19]

Nobuhiro

[11] 4,085,879

[45] Apr. 25, 1978

[54] PAPER SUPPLYING DEVICE IN COIN WRAPPING APPARATUS

[75] Inventor: Iizuka Nobuhiro, Himeji, Japan

[73] Assignee: Glory Kogyo Kabushiki Kaisha, Himeji, Japan

[21] Appl. No.: 810,818

[22] Filed: Jun. 28, 1977

[30] Foreign Application Priority Data

Jul. 5, 1976 Japan ..... 51-79600

[51] Int. Cl.[2] ..... B26F 3/02

[52] U.S. Cl. ..... 225/93; 53/212; 83/650; 133/1 A; 225/106; 242/55.3

[58] Field of Search ..... 83/564, 650; 225/93, 225/106, 35, 72–74; 133/1 R, 1 A; 53/212; 242/55.3, 55.42

[56] References Cited

U.S. PATENT DOCUMENTS

| | | | |
|---|---|---|---|
| 3,367,589 | 2/1968 | Chaut, Jr. et al. | 242/55.3 |
| 3,546,850 | 12/1970 | Hatanaka et al. | 242/55.42 X |
| 3,821,917 | 7/1974 | Hatanaka | 83/650 X |
| 3,899,864 | 8/1975 | Uchida et al. | 53/212 |
| 3,906,964 | 9/1975 | Ushio et al. | 133/1 A |

*Primary Examiner*—Frank T. Yost

*Attorney, Agent, or Firm*—Beveridge, DeGrandi, Kline & Lunsford

[57] ABSTRACT

In a paper supplying device in a coin wrapping apparatus, different kinds of paper, each wound into a paper roll, are supported respectively on corresponding paper supporting members mounted on a paper carrying body. According to the kind of coins selected for wrapping in the coin wrapping apparatus, the paper carrying body is rotated to a position where a suitable kind of paper is supplied to a coin wrapping mechanism of the coin wrapping apparatus and cut into a piece of a predetermined length by a single cutting blade provided stationarily at a position apart from the path of the movement of the paper carrying body. A device for retracting the leading end of the paper inwardly of the carrying body at the time of the paper selecting operation is further provided in each paper supporting member.

4 Claims, 4 Drawing Figures

PAPER SUPPLYING DEVICE IN COIN WRAPPING APPARATUS

BACKGROUND OF THE INVENTION

This invention relates generally to paper supplying devices in coin wrapping apparatuses and more particularly to a paper supplying device in a coin wrapping apparatus wherein several kinds of paper for wrapping respectively different kinds of coins are prepared beforehand, one kind thereof being selectively brought into a paper supplying position, and the paper is cut into a suitable length for wrapping the corresponding coins by a single cutter.

In coin wrapping apparatuses known heretofore, when the denomination (or the size) of coins is to be changed, it has been a common practice to prepare separately various kinds of paper and to selectively and manual insert one kind thereof adapted for a specific size of coins to be wrapped into the coin wrapping apparatus.

Such a procedure is found to be troublesome and inefficient because the existing paper must be removed and now paper must be inserted each time the size of the coins is changed, and any inadvertent neglect of replacement will result in defective wrapping of coins.

For overcoming the above described difficulty of the conventional coin wrapping apparatuses, there has been proposed a construction wherein a number of different kinds of paper, each wound into a roll, are beforehand prepared on a paper carrying body of a movable type, and one kind of paper suitable for the wrapping of a selected kind of coins is brought into the paper supplying position during the operation of the paper carrying body, wherefrom the paper is then delivered into a coin wrapping mechanism.

In this proposed construction of the coin wrapping apparatus, however, a cutter for cutting the paper into a desired length has been provided on the paper carrying body at a position confronting each of the aforementioned paper rolls, and hence a number of cutters corresponding to the number of the paper rolls have been required, giving rise to disadvantageous features such as complication of the construction of the apparatus and consumption of much labor and cost in manufacture.

It has been of course apparent that the employment of a single cutter for cutting different kinds of paper is preferable. However, the mere provision of a single cutter stationarily in an intermediate position between the paper supplying position of the paper carrying body and the coin wrapping mechanism of the coin wrapping apparatus has caused, after a coin wrapping operation, the leading end of the wrapping paper to be used for the succeeding wrapping to be located nearby the cutter or to be somewhat advanced therefrom toward the coin wrapping mechanism. Then, if the paper carrying body is moved in this state for changing the kind of the paper in accordance with the coin size, the leading end of the paper will tend to be caught by the stationary parts of the coin wrapping mechanism. This will give rise to disadvantageous features such as damaging of the leading part of the paper or jamming of the coin wrapping mechanism by the broken end of the paper.

SUMMARY OF THE INVENTION

A primary object of the present invention is to provide a paper supplying device in a coin wrapping apparatus, wherein a single cutting blade is provided for cutting various kinds of the wrapping paper in a manner such that damaging of the leading part of the wrapping paper or jamming of the operation of the succeeding mechanism is prevented.

Another object of this invention is to provide a paper supplying device in coin wrapping apparatus wherein the single cutting blade is kept stationary while the leading part of the wrapping paper is made retractable from the path of the movement of the paper carrying body.

These objects and other objects which are made apparent in the detailed description set forth hereinlater can be achieved by a paper supplying device in a coin wrapping apparatus, comprising a movable paper carrying body and a plurality of paper supporting members provided on the paper carrying body, each of the paper supporting members supporting a specific kind of paper wound into a roll and adapted for wrapping a corresponding kind of coins, the paper carrying body being movable for bringing a selected one of said paper supporting members into a paper supplying position facing the coin wrapping mechanism of the coin wrapping apparatus, the paper supplying device being characterized by a single cutting blade provided stationarily at a position between the paper carrying body and the coin wrapping mechanism and apart from the path of the movement of the paper carrying body, for cutting the paper into a predetermined length, and a paper guiding means provided in each of said paper supporting member for retracting the leading end of the wrapping paper from the path of the movement of the paper carrying body during the paper changing movement of the same paper carrying body.

The nature, principle, and utility of the present invention will be more clearly understood from the following detailed description of the invention when read in conjunction with the accompanying drawings, wherein like parts are designated by like reference numerals.

DETAILED DESCRIPTION

Figure 1:
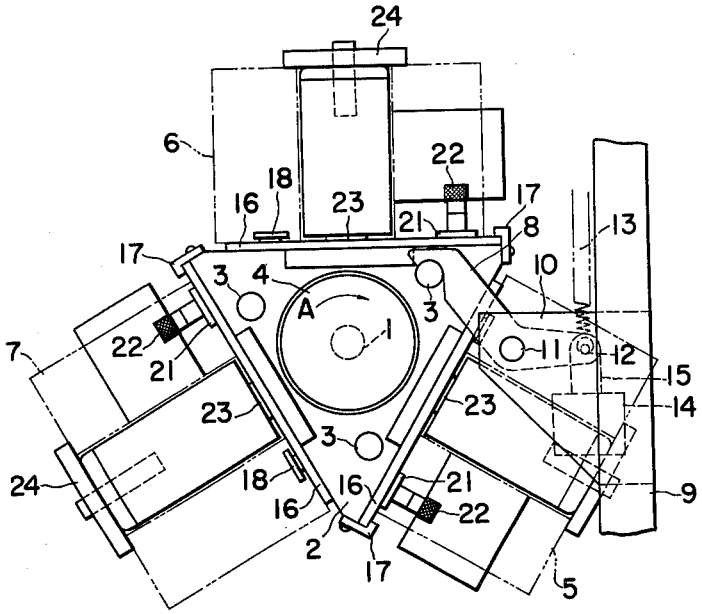
FIG. 1 is an elevational view of an example of a paper supplying device in a coin wrapping apparatus, constituting an embodiment of the present invention.
Figure 2:
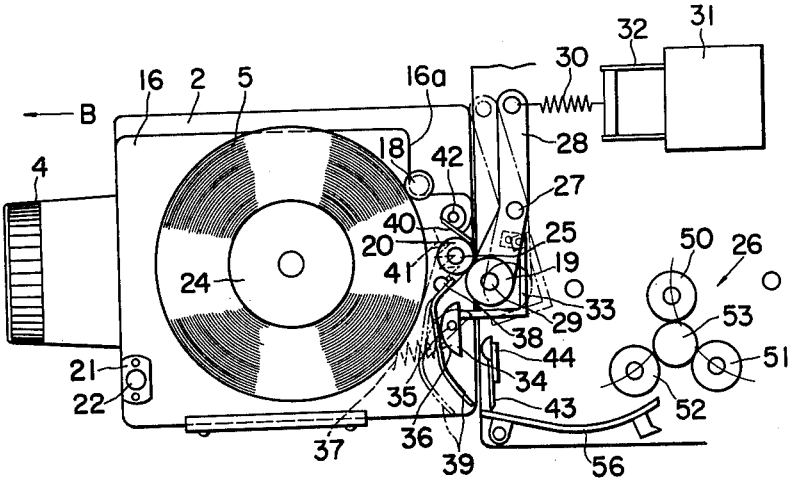
FIG. 2 is a plan view of the same device.

Referring to FIGS. 1 and 2, the paper supplying device illustrated therein has a paper carrier 2 of a substantially triangular cross-sectional shape, rotatably supported by a shaft 1 in a coin wrapping apparatus. An engaging pin 3 is provided on each corner of the triangular paper carrier 2 which can be rotated by means of a knob 4 in the direction of arrow A to position a selected one of paper rolls 5, 6, and 7 carried on the paper carrier 2 at a paper supplying position.

A lever 8 to be operatively engaged at one end thereof with a corresponding engaging pin 3 is provided swingably around a stationary shaft 11 provided on a bracket 10 secured to a structural member 9 of the apparatus. The other end of the lever 8 is connected through a pin 12 with a spring 13 which urges the lever 8 swing around the shaft 11 so that the other end thereof is forced into engagement with the pin 3. The connecting pin 12 at one end of the lever 8 is further connected to a plunger 15 of an electromagnet 14 which, when energized, pulls the first end of the holding lever 8 away from the engaging pin 3. After the disengagement of the holding lever 8 from the engaging pin 3, a mechanism not shown restricts the rotation of the paper carrier 2 to a predetermined extent.

On each side surface of the paper carrier 2, a paper supporting plate 16 is detachably mounted. The plate 16 is inserted between a guide plate 17 secured to the carrier 2 and the side surface thereof whereby the supporting plate 16 is maintained in tight contact with the side surface. On each side surface of the carrier 2, a positioning piece 18 is further provided at a position to abut against a notched part of the paper supporting plate 16. This piece 18 prevents the paper supporting plate 16 from being displaced when the paper is supplied from the paper carrier 2 to the coin wrapping mechanism of the coin wrapping apparatus as will be described hereinlater in more detail.

Furthermore, a positioning plug 22 is provided at each side surface of the carrier 2 to pass through a positioning part 21 of the paper supporting plate 16 into a hole not shown in the paper carrier 2 when the plate 16 is brought into its normal position.

In the case where the paper supporting plate 16 is to be dismounted from the paper carrier 2, the plug 22 is first pulled out of the hole, and then the paper supporting plate 16 can be removed from the paper carrier 2 in the direction of arrow B in FIG. 2.

At the central parts of the paper supporting plates 16, there are provided paper supporting bobbins 23. The aforementioned paper rolls 5, 6, and 7 are supported around the paper supporting bobbins 23 and are held in their positions by paper holding members 24. Furthermore, a roller 20 is rotatably mounted on a shaft 25 provided on each of the paper supporting plates 16 at a position facing the coin wrapping mechanism 26.

A lever 28 swingable around a pivotal shaft 27 secured to a structural member 9 of the apparatus has at one free end thereof a paper feeding roller 19 rotatable around a pin 29. The other end of the lever 28 is connected through a spring 30 to a plunger 32 of an electromagnet 31.

Furthermore, a guiding member 34 contactable with the tip of a branching member 33 fixed to the lever 28 is provided rotatably around a pin 35 secured to the paper supplying position of the paper supporting plate 16. A paper guiding surface 36 is formed on the guiding member 34 on a side opposite to the surface forced into contact the branching member 33. The guiding member 34 is urged by a spring 37 in the clockwise direction, as viewed in FIG. 2, to be brought into contact with the tip of the branching member 33 and to guide the paper inwardly of the paper carrier 2. Prior to the movement of the paper carrier 2 for changing the kind of paper, the lever 28 is rotated counterclockwisely as viewed in FIG. 2. Thus, the pressing force applied by the tip of the branching member 33 to the guiding member 34 is removed, and the guiding member 34 is rotated by the force of the spring 37 in the aforementioned direction for guiding the leading end of the paper inwardly of the paper carrier 2.

A paper guiding plate 39 is provided in opposition to the paper guiding surface 36 of the paper guiding member 34, in a manner to be rotatable around a pin 38 secured to the paper supporting plate 16, and urged by a spring 41 having a spring force weaker than that of the spring 37 in the counterclockwise direction as viewed in the same drawing. The wrapping paper passed around the roller 20 is guided between the plate 39 and the surface 36.

A paper holding member 40 is further provided to be rotatable around a pin 42 secured to the paper supporting plate 16, and urged by a spring (not shown) toward the roller 20 for guiding the wrapping paper therebetween and preventing the paper from becoming slack.

A cutting blade 43 is secured to a stationary rod 44 provided at a position between the paper supplying position of the selected paper supporting plate 16 and the coin wrapping mechanism 26.

When wrapping papers are to be loaded on the paper supplying device, the corresponding paper supporting plates 16 are temporarily removed out of the paper carrier 2, and the required kinds of paper rolls are fitted over the paper supporting bobbins 23. The leading end of each paper is inserted between the roller 20 and the holding member 40, and also between the guide plate 39 and the guiding member 34.

Figure 3:
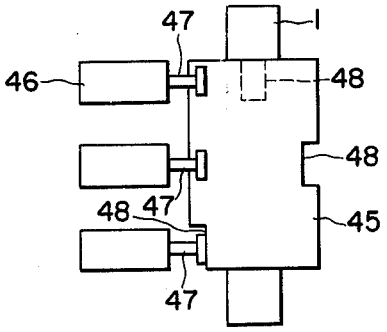
FIG. 3 is an elevational view of operating parts of selecting switches.
Figure 4:
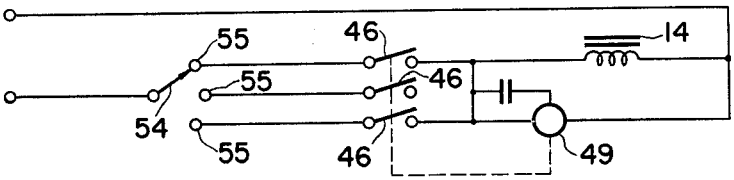
FIG. 4 is an electrical circuit diagram of the selecting switches.

On the rotating shaft 1 of the paper carrier 2, a cam 45 is secured. The operating parts 47 of selectively operable switches 46 provided in correspondence with the kinds of the wrapping paper adapted respectively for the kinds of coins to be wrapped are brought into contact with the cam 45. Recessed portions 48, which engage the operating parts 47 of the switches 46 and disconnect the same switches, are formed around the cam 45 in an angularly displaced relation as shown in FIG. 3.

The selectively operable switches 46 are connected mutually in parallel and inserted in a circuit for energizing an electric motor 49 for rotating the paper carrier 2 and the electromagnet 14.

Upon energization of the electromagnet 14, the holding lever 8 engaged with a pin 3 provided on the paper carrier 2 is rotated around the fixed shaft 11 in a direction to be disengaged from the pin 3, and the paper carrier 2 is placed in a freely rotatable state. The aforementioned selectively operable switches 46 are respectively connected to the stationary contacts 55 of a transfer switch 54.

The coin wrapping mechanism 26 comprises a plurality of wrapping rollers 50, 51, and 52, and a stack of coins 53 inserted between the wrapping rollers are thereby rotated and wrapped by the paper supplied into the same mechanism 26.

The operation of this embodiment of the invention will now be described in detail. When the coin wrapping apparatus is set for a certain kind of coins by rotating the denomination selecting knob with a adjustment shaft (not shown) is thereby rotated, whereby the width of the passage through which coins are propelled, counted, and then successively delivered into the coin wrapping mechanism 26, is varied in accordance with the diameter of the coins 53, and the heights and the positions of the levers for crimp-folding the lateral edges of the wrapped paper at the two ends of the stack of coins 53 are adjusted in accordance with the thickness of the coins. At the same time, the movable contact of the transfer switch 54 of a rotary type is rotated simultaneously. As described hereinbefore, the stationary contacts 55 of the transfer switch 54 are connected to the selectively operable switches 46, respectively. Thus, when the transfer switch 54 is rotated to a position corresponding to the kind of coins, the corresponding one of the selectively operable switches 46 is operated, thereby establishing a circuit for energizing the electric motor 49 and the electromagnet 14.

Upon energization of the electromagnet 14, the holding lever 8 engaged with a pin 3 on the paper carrier 2 is disengaged, and the paper carrier 2 is rotated by the electric motor 49 together with rotating shaft 1. Thus, the cam 45 secured to the shaft 1 is rotated thereby operating the switches 46 sequentially. When a recessed portion 48 of the cam 45 comes to a position disconnecting one of the switches 46 selected by the transfer switch 54, the switch 46 is opened thereby de-energizing the electric motor 49 and the electromagnet 14. The holding lever 8 is then brought into engagement with a pin 3 of the paper carrier 2 which is stopped at a position for supplying the kind of paper suitable for wrapping the coins of the kind for which the apparatus has been set as described hereinabove.

When a predetermined number of coins are successively fed in the form of a stack into the coin wrapping mechanism 26, the electromagnet 31 is operated interrelatedly with the operation of selecting the wrapping paper, thereby rotating the lever 28 in the clockwise direction as viewed in FIG. 2. Thus the paper feeding roller 19 rotatable around the pin 29 secured to an end of the lever 28 is brought into contact against the roller 20. The paper feeding roller 19 is interlinked with an electric motor (not shown) of the coin wrapping mechanism 26, and is operated intermittently with appropriate timing maintained with the operation of the coin wrapping mechanism 26.

Furthermore, the branching member 33, which is secured to the lever 28 and has been retracted from the moving plane of the paper carrier 2, is advanced simultaneously with the rotation of the lever 28 thereby to press the guiding member 34 confronting the guiding plate 39 against the force of the spring 37. Thus, the pressing force exerted upon the guiding plate 39 by the guiding member 34 is removed and the guiding plate 39 is thereby rotated counterclockwisely as viewed in FIG. 2 around the pin 38 under the force of the spring 41. The paper held between the guiding member 34 and the guiding plate 39 is thus advanced toward the cutting blade 43.

Upon the rotation of the paper feeding roller 19, the paper held between the paper feeding roller 19 and the driven roller 20 is fed through the gap between the guiding member 34 and the guiding plate 39 toward the stack of coins 53, being rotated in the coin wrapping mechanism 26, along a guiding device 56. When the leading end of the wrapping paper is caught by the coin wrapping rollers 50, 51, and 52 and started to be wound around the coin stack, a tension is abruptly applied to the paper, and the paper is thereby forced against and cut by the cutting blade 43 into a piece of a predetermined length. It should be noted that the trailing end of this piece of paper is cut in the form of a concave V-shape, and hence the leading end of the paper is formed into a convex V-shape. When a predetermined length of the wrapping paper is fed, the paper feeding roller 19 stops its rotation, and the projecting lateral edges of the paper wrapped around the coin stack 53 are folded and crimped at the upper and lower ends of the coin stack thereby completing the coin wrapping operation.

When the kind of the coins set in the coin wrapping apparatus is changed, the transfer switch 54 is operated in accordance with the new setting, and the thus selected one of the selectively operable switches 46 is connected to the power source. When the switch 46 is in the closed state, the electric motor 49 for rotating the paper carrier 2 and the electromagnet 14 for disengaging the holding lever 8 from the pin 3 are bath energized for disengaging the holding lever 8 from the pin 3 and rotating the paper carrier 2 as described above.

During the above described operation, the electromagnet 31 is deenergized prior to the paper selecting movement of the paper carrier 2, and the lever 28 is rotated counterclockwisely thereby causing the paper feeding roller 19 to retract from the path of movement of the paper carrier 2. Simultaneously, the branching member 33 is disengaged from the guiding member 34, which is in turn rotated against the force of the spring 37 to press the guiding plate 39. Thus the paper guided along the guiding plate 39 is forced inwardly of the paper carrier 2 and the leading end of the paper is retracted from the path of movement of the paper carrier 2.

When the paper carrier 2 is held at a position for supplying a selected kind of paper, the electromagnet 31 is energized for rotating the lever 28 in the clockwise direction, thereby advancing the paper feeding roller 19 from its position of retraction from the path of movement of the paper carrier 2 to a position where it contacts the driven roller 20. Simultaneously, the branching member 33 presses the guiding member 34 which is thereby rotated around the pin 35 against the force of the spring 37, and the wrapping paper is guided by the guiding plate 39 to the supplying position of the paper supporting plate 16.

In the above described embodiment of the present invention, the electromagnet 31, which rotates the lever 28 for advancing and retracting the paper feeding roller 19 and also for pressing the guide member 34, is energized in conjunction with the paper selecting operation, thereby advancing the paper feeding roller 19 from the retracted position to the paper supplying position and furthermore operating the guiding member 34. However, the invention may be organized otherwise in a manner such that the advance of the paper feeding roller 19 from the retracting position to the paper supplying position and also the operation of the guiding member 34 are carried out upon deenergization of the electromagnet 31 in conjunction with the paper selecting operation. Furthermore, the electromagnet 31 may be otherwise energized in connection with the transferring operation of the transfer switch 54, thereby rotating the lever 28, and the electromagnet 14 for disengaging the lever 8 from the pin 3 and the electric motor for rotating the paper carrier 2 may both be energized in connection with the retraction of the lever 28. Alternatively, the lever 28 may also be operated by a cam during the movement of the paper carrier 2.

The paper feeding roller 19, which is rotated intermittently by an electric motor, may be otherwise rotated reversely during the movement of the paper carrier thereby to guide the leading end of the wrapping paper inwardly from the path of the movement of the paper carrier 2. In this way, the paper feeding roller 19 can further function as a paper guiding member.

Alternatively, an electric motor capable of rotating the paper feeding roller and also operable as a guide member in the normal direction and the reverse direction in accordance with the operation of a switch operated by, for instance, a paper selecting knob, may be further provided, and this electric motor may be controlled in such a manner that the length of the paper fed in accordance with the normal and reverse running of the electric motor will be proportional to the advance of the cutting blade 43, which is moved in accorcance with the required cutting length of the paper. This arrangement is suitable for a coin wrapping apparatus for wrapping coins of various kinds having wide differences in diameter.

Alternatively, the paper carrier 2 may be so constructed that it is rotated manually by means of, for instance, the knob 4.

Although in the above described embodiment of the invention, the paper has been forced against the cutting blade 43 by a tension produced therein at the time when the paper is caught between the plurality of wrapping rollers 50, 51, and 52 and the coin stack, another roller may be provided at an intermediate position between the coin wrapping mechanism 26 and the cutting blade 43 thereby to produce a tension in the paper for cutting the same.

I claim:

1. In a paper supplying device in a coin wrapping apparatus, comprising a movable paper carrying body and a plurality of paper supporting members provided on said paper carrying body, each of the paper supporting members supporting a specific kind of paper wound into a roll and adapted for wrapping a corresponding kind of coins, said paper carrying body being movable for bringing the paper supporting member corresponding to a selected kind of coins into a paper supplying position facing a coin wrapping mechanism of the coin wrapping apparatus, the improvement comprising a single cutting blade provided stationarily at a position between the paper carrying body and the coin wrapping mechanism and apart from the path of the movement of the paper carrying body, for cutting the paper into a piece of a predetermined length, and means for guiding paper provided in each of said paper supporting members for retracting the leading end of the wrapping paper from said path during the paper changing movement of said paper carrying body.

2. A paper supplying device as set forth in claim 1 wherein said means for guiding paper comprises a paper guiding plate rotatable around a pin and urged by a first spring toward said path of the movement of said paper carrying body, and a paper guiding member also rotatable around a pin and urged by a second spring to press said paper guiding plate into a position retracted from said path.

3. A paper supplying device as set forth in claim 2 wherein the force of said first spring is selected to be weaker than that of said second spring, so that said paper guiding plate is normally kept in the position retracted from said path.

4. A paper supplying device as set forth in claim 2 wherein said paper guiding member is rotated around said pivot pin against the force of said second spring by a lever swingable in accordance with the setting for a selected kind of coins.

* * * * *